US009498989B2

(12) United States Patent
Sasaki

(10) Patent No.: US 9,498,989 B2
(45) Date of Patent: Nov. 22, 2016

(54) RECORDING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/159,937

(22) Filed: Jan. 21, 2014

(65) Prior Publication Data

US 2014/0203489 A1 Jul. 24, 2014

(30) Foreign Application Priority Data

Jan. 23, 2013 (JP) ..... 2013-010163

(51) Int. Cl.
*B65H 19/22* (2006.01)
*B41J 15/16* (2006.01)
*B65H 19/28* (2006.01)

(52) U.S. Cl.
CPC ..... *B41J 15/16* (2013.01); *B65H 19/22* (2013.01); *B65H 19/2215* (2013.01); *B65H 19/283* (2013.01); *B65H 2301/5151* (2013.01); *B65H 2408/231* (2013.01); *B65H 2801/12* (2013.01); *B65H 2801/36* (2013.01)

(58) Field of Classification Search
CPC ..... B65H 19/22
See application file for complete search history.

(56) References Cited

U.S. PATENT DOCUMENTS 1,958,068 A * 5/1934 Raiche ..... 242/523.1
2,970,786 A * 2/1961 Justus et al. ..... 242/533.6
3,093,336 A 6/1963 Caulfield et al.
3,462,093 A * 8/1969 Peery ..... 242/523
3,472,462 A * 10/1969 Young ..... 242/523.1
3,794,256 A * 2/1974 Schwarz ..... 242/527.3
4,431,140 A * 2/1984 Tetro ..... 242/533.4
4,588,138 A * 5/1986 Spencer ..... 242/533.6
5,054,707 A * 10/1991 Olson ..... 242/533.5
5,215,276 A * 6/1993 Aoki et al. ..... 242/533.4
5,810,280 A * 9/1998 Ryan et al. ..... 242/521

FOREIGN PATENT DOCUMENTS

JP 6-8553 1/1994
JP 11-115166 4/1999

OTHER PUBLICATIONS

European Search Report for European Patent Application No. 14152287.0 dated May 21, 2014.

* cited by examiner

*Primary Examiner* — Jill Culler
(74) *Attorney, Agent, or Firm* — Workman Nydegger

(57) ABSTRACT

A recording apparatus includes: a transport mechanism that transports a recording medium; a recording head that performs recording on the recording medium transported by the transport mechanism; a plurality of winding sections, each winding in a corresponding recording medium on which recording has been completed by the recording head; a cutting section that cuts the recording medium; and a guiding section that, when the winding section that winds in the recording medium is switched from one winding section to another winding section of the plurality of winding sections, guides a leading edge of the recording medium formed by cutting with the cutting section, to the other winding section.

3 Claims, 6 Drawing Sheets

RECORDING APPARATUS

BACKGROUND

1. Technical Field

The present invention relates to a recording apparatus which includes winding sections, each winding in a corresponding recording medium on which recording has been completed.

2. Related Art

Recording apparatuses that perform recording on recording media have been used. When images are recorded on recording media using such a recording apparatus, it may be desirable to wind in a recording medium on which recording has been completed, separately from another recording medium depending on the type of recorded images or the like. However, this requires effort and time in that, every time recording of one type of image is finished, the recording operation is suspended and a recording medium on which recording has been completed is wound into a roll and removed from the recording apparatus, and subsequently a new roll is formed.

Therefore, for example, JP-A-11-115166 discloses a recording apparatus which includes a turret on which a plurality of winding shafts are disposed. Each of the winding shafts winds in a corresponding recording medium. The recording apparatus disclosed in JP-A-11-115166 can wind in one recording medium on which recording has been completed, around a corresponding one of the winding shafts separately from another medium without the recording operation being suspended.

However, the recording apparatus in JP-A-11-115166 has a configuration in which the one recording medium on which recording has been completed can be wound in separately from the other recording medium but the workload is heavy when the winding shaft is switched from one winding shaft to another winding shaft. This is because the switching of the winding shaft from the one winding shaft to the other winding shaft needs cutting of the recording medium and may require effort and time or the like depending on the type, size, or the like of the recording medium when a leading edge of the recording medium formed by cutting is placed on the other winding shaft.

That is, a recording apparatus of the related art including a winding section that winds in recording media on which recording has been completed requires a heavy workload to separately wind in the recording media on which recording has been completed depending on the type of recorded images or the like, which leads to poor productivity.

SUMMARY

An advantage of some aspects of the invention is that the workload when one recording medium on which recording has been completed is wound in separately from another recording medium depending on the type of the recorded images or the like is reduced, thereby increasing productivity.

A recording apparatus according to an aspect of the invention includes: a transport mechanism that transports a recording medium; a recording head that performs recording on the recording medium transported by the transport mechanism; a plurality of winding sections, each winding in a corresponding recording medium on which recording has been completed by the recording head; a cutting section that cuts the recording medium; and a guiding section that, when the winding section that winds in the recording medium is switched from one winding section to another winding section of the plurality of winding sections, guides a leading edge of the recording medium formed by cutting with the cutting section, to the other winding section.

According to this aspect, when the leading edge of the recording medium formed by cutting is placed on another winding shaft, the leading edge is guided to the other winding section, whereby the workload can be reduced.

In the recording apparatus, the guiding section may include a contact portion that contacts the recording medium so as to adjust the tension of the recording medium when the recording medium is wound in and a guiding surface that guides the leading edge of the recording medium when one winding section that winds in the recording medium is switched to the other winding section.

"A contact portion that contacts the recording medium so as to adjust the tension of the recording medium when the recording medium is wound in" is a member used for reducing poor winding in when the recording medium is wound in, by adjusting the tension of the recording medium. For example, the contact portion is a so-called tension bar or the like that presses the recording medium against the surface thereof opposite the surface on which recording has been completed.

In this case, the guiding section also serves as a member that adjusts the tension of the recording medium. Accordingly, poor winding in, when the recording medium is wound in, can be reduced without use of any other components.

In the recording apparatus, the contact portion and the guiding surface of the guiding section may be integrated with each other.

In this case, the contact portion and the guiding surface of the guiding section are integrated with each other so that productivity can be increased and poor winding in when the recording medium is wound in can be reduced while the guiding section has a simple configuration and is made at low cost.

The recording apparatus may further include a turret on which the plurality of winding sections are disposed. The turret is capable of moving the other winding section upstream of the one winding section in the transport direction of the recording medium when the winding section that winds in the recording medium is switched.

In this case, the recording apparatus has a configuration in which the workload when the recording medium is placed on a new winding section is reduced, and the roll of the recording medium which has been wound in is easily collected because the winding section on which the winding in of the recording medium P has been completed moves downward in the transport direction.

In the recording apparatus, the guiding section may include a curved portion extending along a portion of at least one of the plurality of winding sections and a guiding surface, which extends from the curved portion, and guide the leading edge of the recording medium.

In this case, although the guiding section has a simple configuration, the guiding section guides the leading edge of the recording medium. That is, productivity can be increased at low cost.

In the recording apparatus, each of the guiding sections is disposed around a corresponding one of the plurality of winding sections.

In this case, each guiding section is disposed around a corresponding one of the plurality of winding sections so that any winding section may be used as a winding section that winds in the recording medium first, whereby the workload when one recording medium is wound in separately from another recording medium can be further reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIG. 1 and FIGS. 2A, 2B, and 2C

Recording apparatuses according to embodiments of the invention will be described in detail with reference to the accompanying drawings.

First, a recording apparatus according to a first embodiment of the invention will be described.

Figure 1:
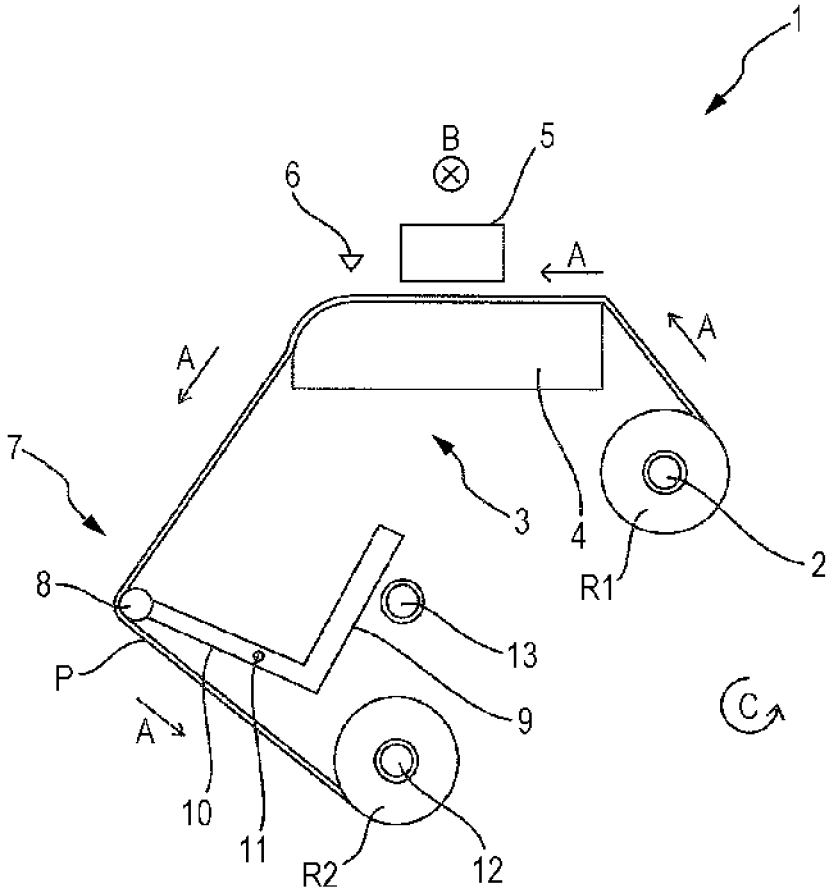
FIG. 1 is a schematic elevational view illustrating a recording apparatus according to a first embodiment of the invention.

FIG. 1 illustrates a schematic elevational view of a recording apparatus 1 according to the first embodiment of the invention.

The recording apparatus 1 in the first embodiment includes a setting section 2 for a recording medium P which can feed a length of a roll R1 of the recording medium P for performing recording. The recording apparatus 1 in the first embodiment employs a roll of the recording medium as the recording medium P; however, the recording apparatus 1 may be a recording apparatus including a winding mechanism that winds in the recording medium on which recording has been completed and is not limited to the recording apparatus employing such a roll of the recording medium.

The setting section 2 of the recording apparatus 1 in the first embodiment rotates in a rotation direction C when the recording medium P is transported.

In addition, the recording apparatus 1 in the first embodiment includes a transport mechanism 3 that transports a roll of the recording medium P in a transport direction A. The transport mechanism 3 has a platen 4 including a heater (not shown) which can heat the recording medium P and the transport mechanism 3 further includes a plurality of transporting rollers (not shown).

In addition, the recording apparatus 1 includes a recording mechanism that performs recording by reciprocal scanning of a recording head 5 in a scanning direction B intersecting with the transport direction A of the recording medium P. The recording apparatus 1 in the first embodiment includes the recording mechanism that performs recording by reciprocal scanning of the recording head 5; however the recording apparatus 1 may be a recording apparatus including a so-called line head provided with a plurality of nozzles that discharge inks in a direction intersecting with the transport direction A.

A cutter 6 serving as a cutting section which can cut the recording medium P is disposed downstream of the recording head 5 in the transport direction A of the recording medium P.

In addition, a guiding section 7 which adjusts the tension of the recording medium P when the recording medium P is wound in and which guides the recording medium P when the recording medium P is wound in is disposed downstream of the cutter 6 in the transport direction A of the recording medium P.

The guiding section 7 has a guiding surface 9 which can guide the recording medium P and an intersecting surface 10 which intersects with the guiding surface 9 and includes a contact portion 8, disposed at the tip of the intersecting surface 10, that contacts the recording medium P so as to adjust the tension of the recording medium P. That is, the contact portion 8 and the guiding surface 9 are integrated with each other. In addition, the guiding section 7 can rotate about a rotation shaft 11, and the rotation shaft 11 extends in a direction along which the guiding surface 9 and the intersecting surface 10 intersect with each other (parallel to the scanning direction B in the first embodiment).

The guiding section 7 also serves as an adjusting member that adjusts the tension of the recording medium P so that poor winding in can be reduced without any additional components when the recording medium P is wound in.

Winding sections 12 and 13 which can wind in the recording media P are disposed downstream of the guiding section 7 in the transport direction A of the recording medium P. FIG. 1 illustrates a state in which the winding section 12 winds in the recording medium P to form a roll R2.

The winding sections 12 and 13 of recording apparatus 1 in the first embodiment rotate in the rotation direction C when the recording medium P is being wound in.

The operation of the guiding section 7 of the recording apparatus 1 in the first embodiment when the winding section that winds in the recording medium P is switched will now be described.

Figure 2A:
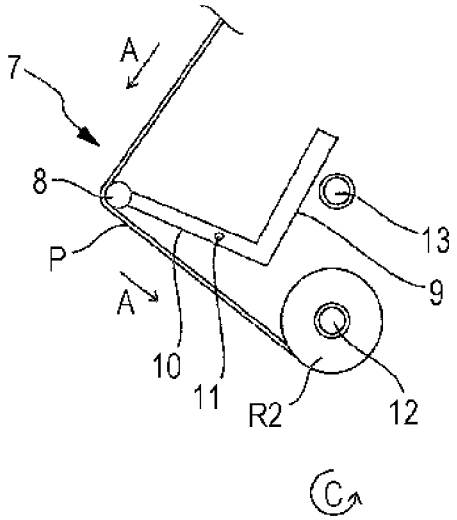
FIGS. 2A, 2B, and 2C are views for describing the operation of a guiding section of the recording apparatus according to the first embodiment of the invention.
Figure 2B:
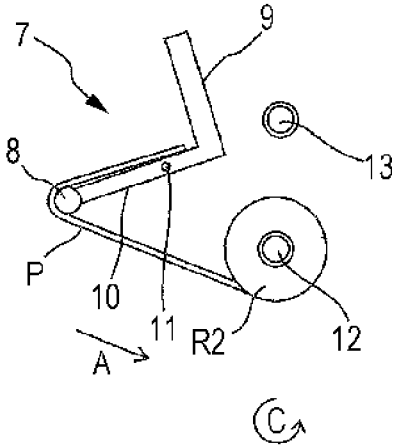
Figure 2C:
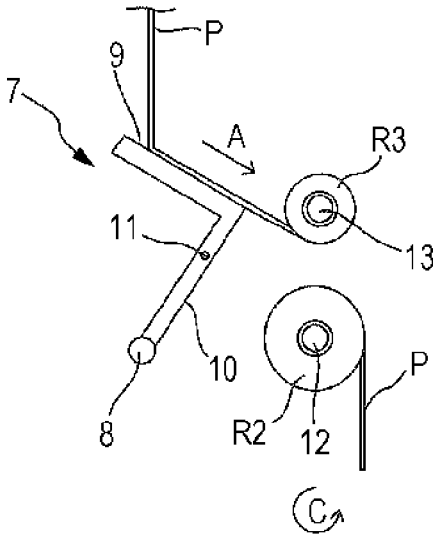

FIGS. 2A, 2B, and 2C are views for describing the operation of the guiding section of the recording apparatus in the first embodiment. FIG. 2A illustrates the winding section 12 winding in the recording medium P. FIG. 2B illustrates a state in which the winding section that winds in the recording medium P is being switched from the winding section 12 to the winding section 13. FIG. 2C illustrates a state in which the winding section 13 starts winding in of the recording medium P.

As illustrated in FIGS. 2A and 2B, when the winding section that winds in the recording medium P is switched from the winding section 12 to the winding section 13, the guiding section 7 rotates about the rotation shaft 11 in the rotation direction C. FIG. 2B illustrates a state in which the cutter 6 has cut the recording medium P.

The winding section that winds in the recording medium P can be switched while recording is being performed.

FIG. 2C illustrates the position of the guiding section 7 when recording is being performed without interruption after the cutter 6 cuts the recording medium P, the guiding surface 9 of the guiding section 7 guides the leading edge of the recording medium P to the winding section 13, and the winding section 13 starts winding in the recording medium P. As illustrated in FIG. 2C, when the winding section that winds in the recording medium P is switched from the one winding section 12 to the other winding section 13 of the plurality of winding sections, the guiding section 7 guides the leading edge of the recording medium P formed by cutting with the cutter 6 to the other winding section 13. In this manner, a new roll R3 is formed around the winding section 13.

As illustrated in FIG. 2A to FIG. 2C, the guiding section 7 of the recording apparatus 1 in the first embodiment rotates about the rotation shaft 11 as cutting of the recording medium P is performed by the cutter 6 when the winding sections that wind in the recording medium P are switched between. Then, the guiding section 7 moves the guiding surface 9 to a position at which the guiding surface can guide the leading edge of the recording medium P.

The recording apparatus 1 in the first embodiment is configured such that, when the leading edge of the recording medium P formed by cutting is placed on the other winding shaft, the leading edge is guided to the other winding section, whereby the workload can be reduced. In addition, the leading edge of the recording medium P has been guided between the guiding surface 9 and the winding section 13, so that the leading edge can be suitably wound in on a sticky material on the surface of a paper core prepared in advance at the winding section 13.

The guiding section 7 of the recording apparatus 1 in the first embodiment is configured to rotate in the rotation direction C under its own weight when the recording medium P is cut. However, the guiding section 7 is not limited to such a configuration and, for example, may have a configuration in which a rotation mechanism and a control section thereof are provided and the control section controls the rotation mechanism to cause the guiding section 7 to rotate.

Second Embodiment

Figure 3A:
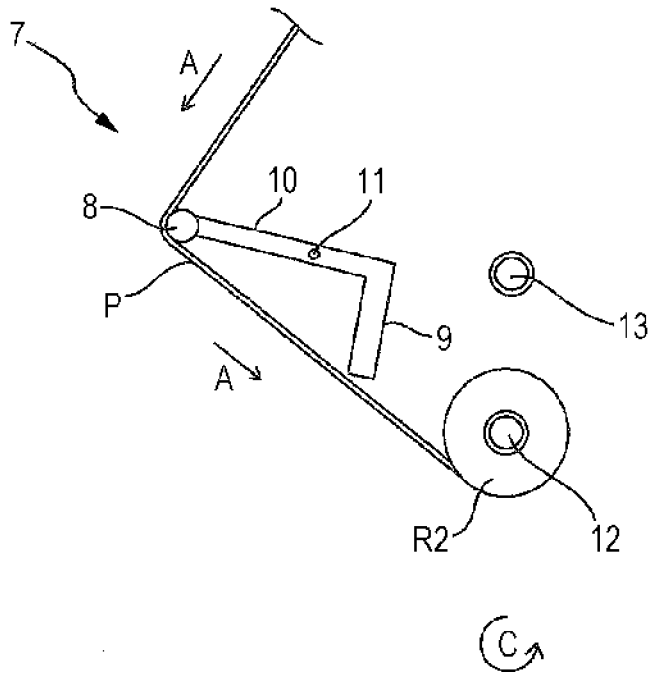
FIGS. 3A and 3B are views for describing the operation of a guiding section of a recording apparatus according to a second embodiment of the invention.
Figure 3B:
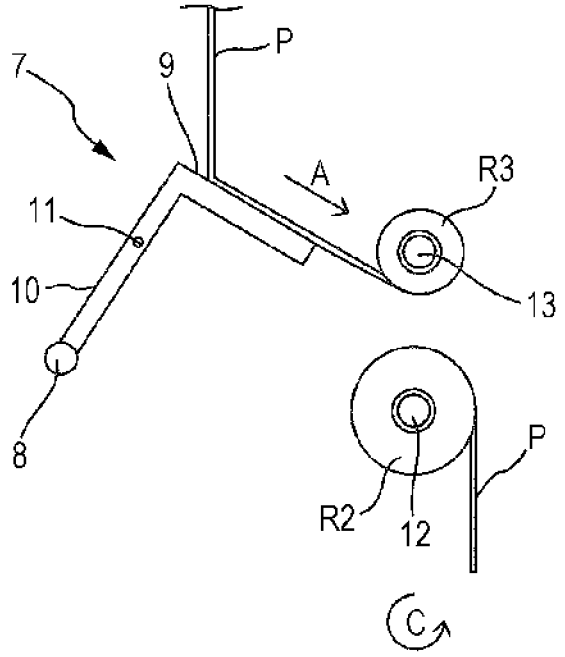

FIGS. 3A and 3B

A recording apparatus according to a second embodiment of the invention will be described.

FIGS. 3A and 3B illustrate a main part of the recording apparatus 1 according to the second embodiment of the invention and are views for describing the operation of the guiding section 7. Components the same as those in the first embodiment are denoted by the same numerals, and detailed description thereof will be omitted.

In addition, FIG. 3A illustrates a state in which a winding section 12 winds in a recording medium P. FIG. 3B illustrates a state in which a winding section 13 starts winding in of the recording medium P.

The recording apparatus 1 in the second embodiment differs from the recording apparatus 1 in the first embodiment only in terms of the shape of the guiding section 7. In particular, the line of intersection of the guiding surface 9 and the intersecting surface 10 of the guiding section 7 of the recording apparatus 1 in the second embodiment with respect to the guiding surface 9 is positioned on the opposite side compared to in the guiding section 7 of the recording apparatus 1 in the first embodiment.

As is the case with the recording apparatus 1 in the first embodiment, the guiding section 7 in the recording apparatus 1 in the second embodiment also rotates in the rotation direction C under its own weight when the recording medium P is cut and, in the position illustrated in FIG. 3B, guides the leading edge of the recording medium P to the winding section 13.

Third Embodiment

FIG. 4 and FIGS. 5A, 5B, and 5C

Next, a recording apparatus according to a third embodiment of the invention will be described.

Figure 4:
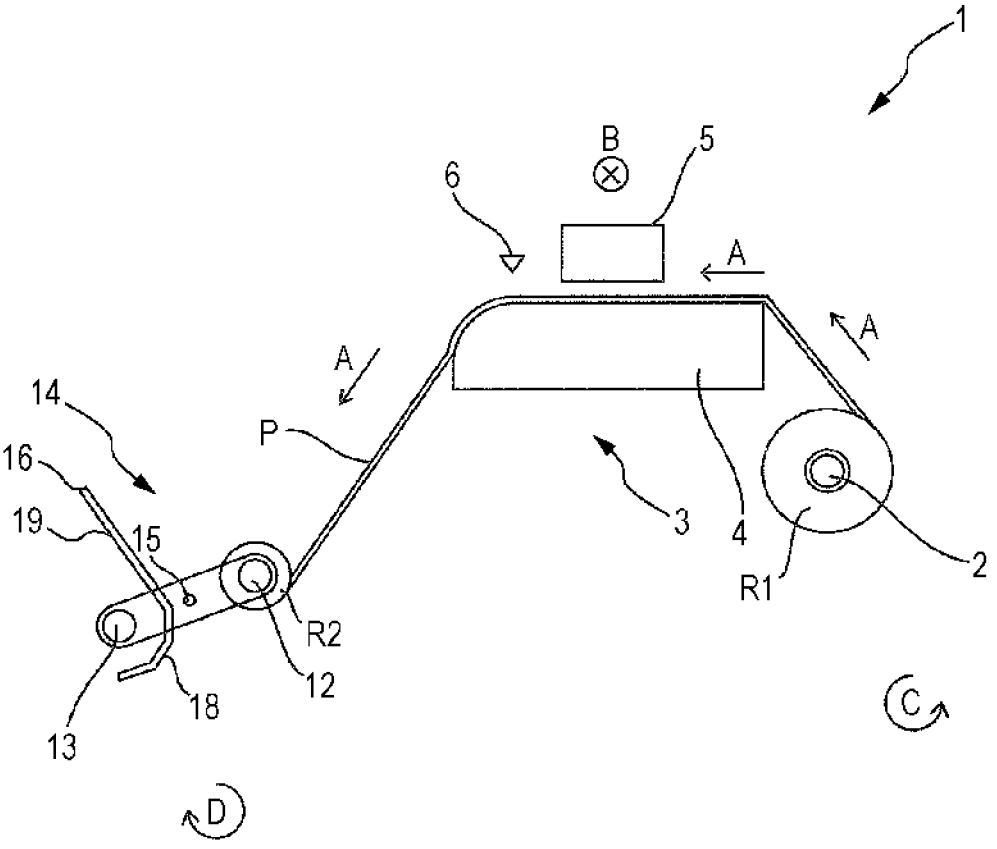
FIG. 4 is a schematic elevational view illustrating a recording apparatus according to a third embodiment of the invention.

FIG. 4 illustrates a schematic elevational view of the recording apparatus 1 according to the third embodiment of the invention. Components the same as those in the first and second embodiments are denoted by the same numerals, and detailed description thereof will be omitted.

The recording apparatus 1 in the third embodiment includes a turret 14 which can rotate about a rotation shaft 15 and on which winding sections 12 and 13 are disposed. The winding sections 12 and 13 can wind in the recording medium P by rotating in the rotation direction D. In addition, the winding section 13 is provided with a guiding section 16 which has: a curved portion 18 extending along a portion of the winding section 13; and a guiding surface 19 which extends from the curved portion 18 and guides the leading edge of the recording medium P.

The operation of the turret 14 of the recording apparatus 1 in the third embodiment when the winding section that winds in the recording medium P is switched will be described.

Figure 5A:
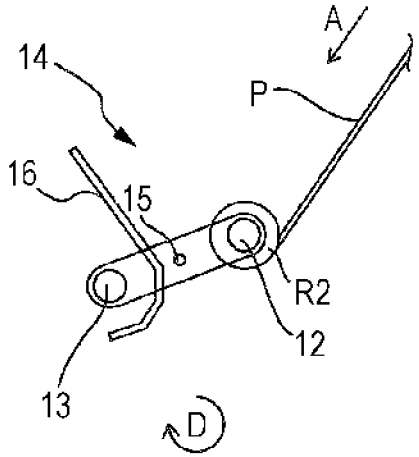
FIGS. 5A, 5B, and 5C are views for describing the operation of a turret of the recording apparatus according to the third embodiment of the invention.
Figure 5B:
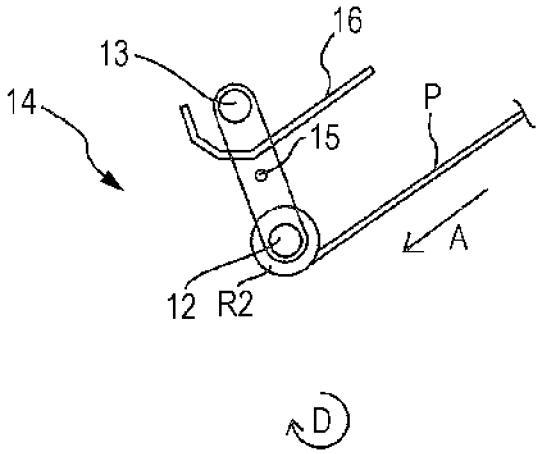
Figure 5C:
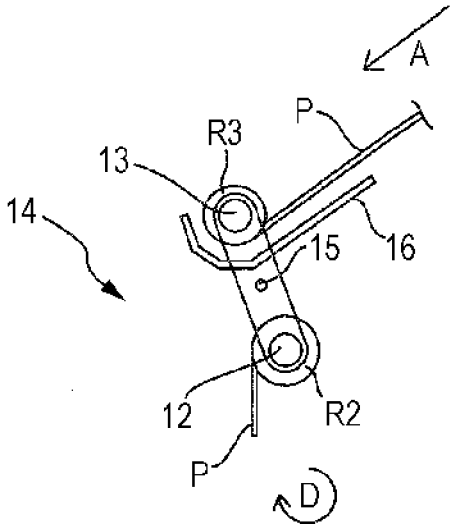

FIGS. 5A, 5B, and 5C are views for describing the operation of the turret 14 of the recording apparatus 1 in the third embodiment. In addition, FIG. 5A illustrates the winding section 12 winding in the recording medium P. FIG. 5B illustrates a state in which the winding section that winds in the recording medium P being switched from the winding section 12 to the winding section 13. FIG. 5C illustrates a state in which the winding section 13 starts winding in of the recording medium P.

As illustrated in FIGS. 5A and 5B, the turret 14 rotates about the rotation shaft 15 in the rotation direction D when the winding section that winds in the recording medium P is switched from the winding section 12 to the winding section 13. FIG. 5B illustrates a state in which the cutter 6 has cut the recording medium P and a state in which the turret 14 is rotating in the rotation direction D under its own weight including the weight of the winding section 12 and the weight of the roll R2 when the recording medium P is cut.

The winding section that winds in the recording medium P can be switched while recording is being performed.

FIG. 5C illustrates the position of the guiding section 16 when recording is performed without interruption after the cutter 6 cuts the recording medium P, the guiding surface 19 of the guiding section 16 guides the leading edge of the recording medium P to the one winding section 13, and the other winding section 13 starts to wind in the recording medium P. As illustrated in FIG. 5C, when the winding section that winds in the recording medium P is switched from one winding section 12 to another winding section 13 of the plurality of winding sections, the guiding section 16 guides the leading edge of the recording medium P formed by cutting with the cutter 6, to the other winding section 13. In this manner, a new roll R3 is formed around the winding section 13.

As illustrated in FIG. 5A to FIG. 5C, the turret 14 rotates about the rotation shaft 15 of the recording apparatus 1 in the third embodiment as cutting of the recording medium P is performed by the cutter 6 when the winding section that winds in the recording medium P is switched. Then, the turret 14 moves the guiding section 16 to a position at which it can guide the leading edge of the recording medium P.

The recording apparatus 1 in the third embodiment is configured so that, when the leading edge of the recording medium P formed by cutting is placed on the other winding shaft, the leading edge is guided to the other winding section, whereby the workload can be reduced.

The turret 14 of the recording apparatus 1 in the third embodiment is configured to rotate in the rotation direction D under its own weight including the weight of the winding section 12 and the weight of the roll R2 when the recording medium P is cut. However, the turret 14 is not limited to such a configuration and, for example, may have a configuration in which a rotation mechanism and a control section thereof are provided and the control section controls the rotation mechanism to cause the turret 14 to rotate. In addition, the guiding section 16 may be configured to be spaced apart from the winding section 13 depending on the diameter of the roll R3.

In addition, the turret 14 of the recording apparatus 1 in the third embodiment moves the winding section 13 upstream of the winding section 12 in the transport direction A when the winding section that winds in the recording medium P is switched from the winding section 12 to the winding section 13. Accordingly, the recording apparatus 1 has a configuration in which the workload when the recording medium P is placed on a new winding section 13 is reduced, and the roll R2 of the recording medium P which has been wound in is easily collected because the winding section 12 on which the winding in of the recording medium P has been completed moves downward in the transport direction A. However, it is not limited to such a configuration.

Fourth Embodiment

FIG. 6

A recording apparatus according to a fourth embodiment of the invention will now be described.

Figure 6:
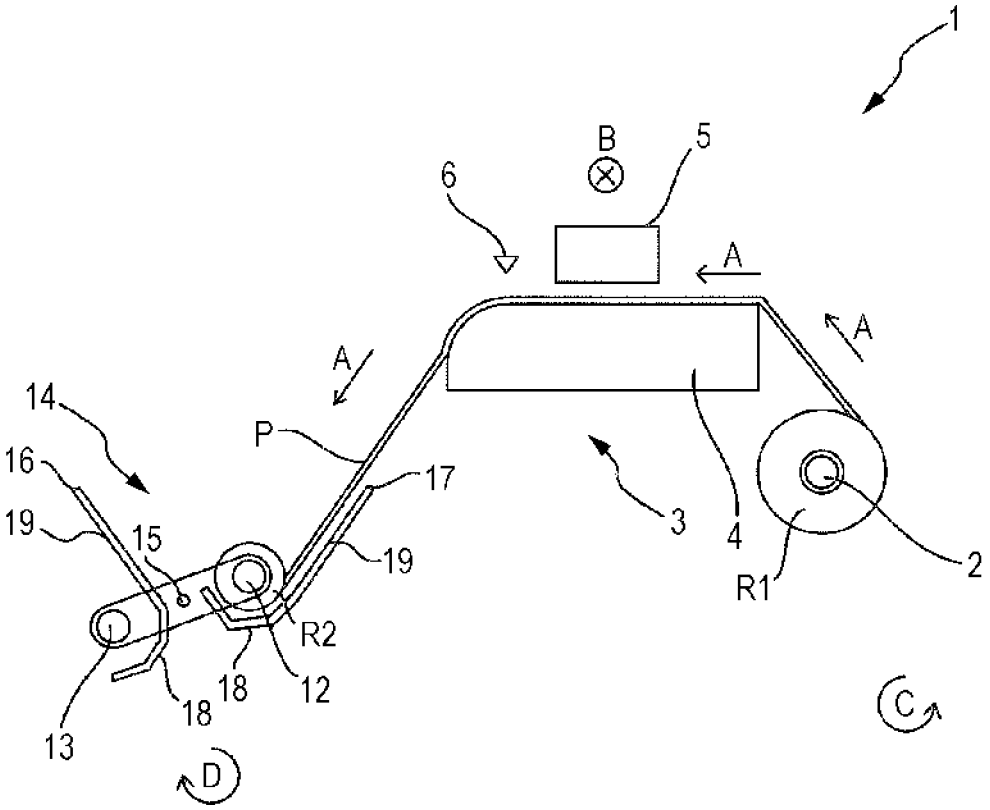
FIG. 6 is a schematic elevational view illustrating a recording apparatus according to a fourth embodiment of the invention.

FIG. 6 illustrates a schematic elevational view of the recording apparatus 1 according to the fourth embodiment of the invention. Components the same as those in the first to third embodiments are denoted by the same numerals, and detailed description thereof will be omitted.

The recording apparatus 1 in the fourth embodiment differs from the recording apparatus 1 in the third embodiment only in the fact that a guiding section 17 is also disposed around the winding section 12 in addition to a guiding section 16 disposed around the winding section 13. The guiding section 17 has a similar shape to the guiding section 16, and has: a curved portion 18 extending along a portion of the winding section 12; and a guiding surface 19 which extends from the curved portion 18 and guides the leading edge of the recording medium P.

The recording apparatus 1 in the third embodiment has a configuration in which the guiding section 16 is disposed only around the winding section 13 so that it is precondition that the medium P is wound in around the winding section 12 first. On the other hand, the recording apparatus 1 in the fourth embodiment has a configuration in which each guiding section is disposed around a corresponding one of the winding section 12 and the winding section 13 (around any of the plurality of winding sections) so that any guiding section may be used first, whereby the workload when one recording medium is separated from another recording medium can be further reduced.

In the above embodiments, the recording medium P has been described as being the wound roll R1; however it is not limited to this and the recording medium P may be a folded medium or a medium fed directly into the recording apparatus 1. In addition, the recording medium P is not limited to a recording medium on which information is to be printed, and may be a recording medium on which information or an image is to be printed, such as cloth used for textile printing, a transfer paper sheet, a plastic medium used for an illumination lamp, an advertisement, a label or the like.

In addition, recording apparatuses including two winding sections as a plurality of winding sections have been described in the above embodiments; however, the recording apparatus may include three or more winding sections.

The entire disclosure of Japanese Patent Application No. 2013-010163, filed Jan. 23, 2013 is expressly incorporated by reference herein.

What is claimed is:

1. A recording apparatus comprising:

a transport mechanism that transports a recording medium;

a recording head that performs recording on the recording medium transported by the transport mechanism;

a plurality of winding sections including a first winding section and a second winding section, each winding in a corresponding recording medium on which recording has been completed by the recording head;

a cutting section that cuts the recording medium; and a guiding section that adjusts a tension of the recording medium going to the first winding section and, when the recording medium is switched from the first winding section to the second winding section, rotates about a rotation shaft to a position to guide a leading edge of the recording medium formed by cutting with the cutting section to the second winding section, wherein the cutting section is separate from the guiding section and is arranged upstream of the guiding section, wherein the guiding section includes a first end and a second end disposed on opposite sides of a rotation shaft, wherein the first end and the second end are connected by an intersecting body, wherein the first end adjusts the tension of the recording medium and wherein the second end includes a guiding surface that guides the recording medium to the second winding section.

2. The recording apparatus according to claim 1, wherein the guiding section includes a contact portion that contacts the recording medium so as to adjust the tension of the recording medium when the recording medium is wound in; and a guiding surface that guides the leading edge of the recording medium when one winding section that winds in the recording medium is switched to the other winding section.

3. The recording apparatus according to claim 2, wherein the contact portion and the guiding surface of the guiding section are integrated with each other.

* * * * *